United States Patent [19]

Kerr

[11] 4,236,719

[45] Dec. 2, 1980

[54] COMPETITIVE WORD GAME

[76] Inventor: Thomas R. Kerr, P.O. Box 1911, St. Augustine, Fla. 32084

[21] Appl. No.: 68,121

[22] Filed: Aug. 20, 1979

[51] Int. Cl.[3] ..... A63F 3/00

[52] U.S. Cl. ..... 273/265; 273/272

[58] Field of Search ..... 273/148 A, 265, 272

[56] References Cited

U.S. PATENT DOCUMENTS

| | | | |
|---|---|---|---|
| 3,096,092 | 7/1963 | Bredehorn | 273/272 |
| 4,043,053 | 8/1977 | Kaye | 35/DIG. 3 X |
| 4,188,036 | 2/1980 | Jones-Fenleigh | 273/265 |

OTHER PUBLICATIONS

Playthings, Mar. 1964, p. 409, Probe TM.

*Primary Examiner*—Anton O. Oechsle

*Attorney, Agent, or Firm*—Norman B. Rainer

[57] ABSTRACT

A game is provided involving the spelling of words, and played competitively by two to four participants. The game is comprised of a series of elongated word cards having a word printed on one face thereof, multi-apertured holders adapted to accommodate several of said word cards, elongated blank cards adapted to cover said word cards, a multitude of flat elongated shutters adapted to be vertically positioned to separately occlude individual apertures of said holders, a first series of playing pieces serving to expedite the playing of the game, a second series of playing pieces which facilitate scorekeeping, and a number-selecting means such as a pair of dice.

6 Claims, 5 Drawing Figures

COMPETITIVE WORD GAME

BACKGROUND OF THE INVENTION

I. Field of the Invention

This invention relates to a game and, more particularly to an educational and entertaining game involving the spelling of words.

II. Description of the Prior Art

While many educational and entertaining games have been devised which, as their primary purpose, employ the use of the alphabet to permit the participants to spell out one or more words, the applicant is not aware of any game which involves the principles, objectives and physical structure proposed in applicant's invention.

Examples of prior art word games and word educational devices which are known to applicant are U.S. Pat. No. 3,096,092, issued July 2, 1963 to Bredehorn; U.S. Pat. No. 3,101,556, issued Aug. 27, 1963 to Di-Ponte; U.S. Pat. No. 3,858,333, issued Jan. 7, 1975 to Kopp; U.S. Pat. No. 4,084,816, issued Apr. 18, 1978 to Shafer; and U.S. Pat. No. 3,081,560, issued Mar. 19, 1963 to Agud.

SUMMARY OF THE INVENTION

The game of the present invention comprises a plurality of game pieces including a series of elongated cards, some having a word printed thereon, multi-apertured holders adapted to accommodate several of said elongated cards, a multitude of flat elongated shutters adapted to be vertically positioned to separately occlude the individual apertures of said holders, said shutters having numerical indicia adjacent their upper extremities on both sides thereof, a first series of playing pieces serving to expedite the playing of the game, a second series of playing pieces which facilitate score-keeping, and number selecting means such as a pair of dice.

It is an object of the present invention to provide a new and improved word game to be played competitively by two to four players.

It is a further object of the present invention to provide a new and improved word game permitting adaptation of the degree of difficulty of the game words to suit the general abilities of the players.

It is a still further object to provide a game of the aforesaid nature wherein the winning of the game is based upon factors of skill and chance.

These objects and other objects and advantages of the invention will be apparent from the following description.

BRIEF DESCRIPTION OF THE DRAWINGS

For a fuller understanding of the nature and objects of the invention, reference should be had to the following detailed description taken in connection with the accompanying drawings forming a part of this specification and in which similar numerals of reference indicate corresponding parts in all the figures of the drawing.

DESCRIPTION OF THE PREFERRED EMBODIMENT

Figure 1:
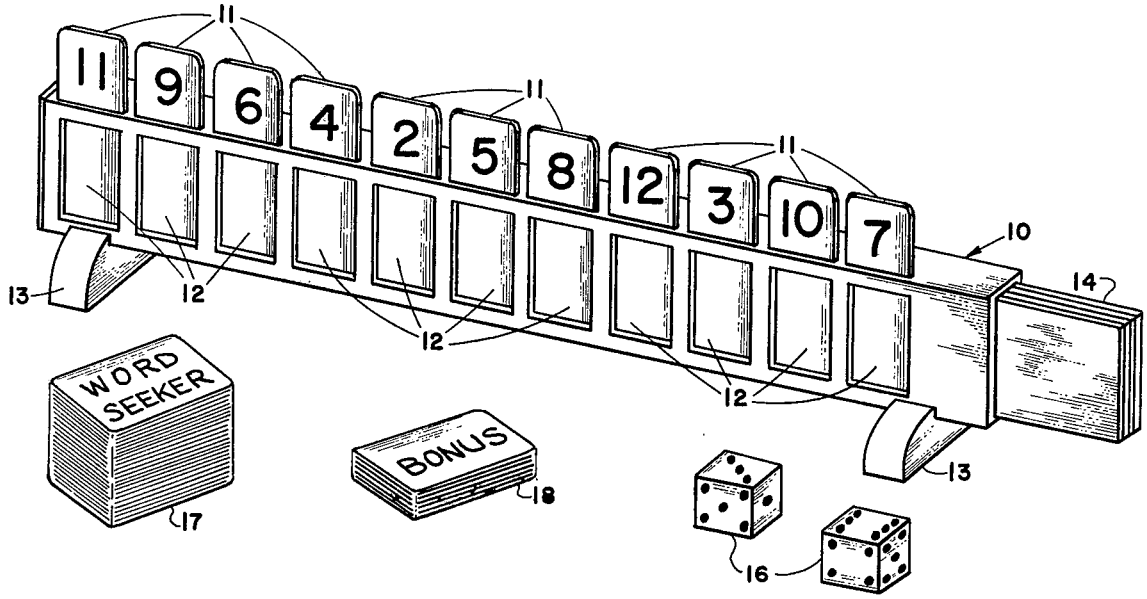
FIG. 1 is an isometric view of the components of the game of this invention disposed substantially in playing position.

Referring to FIG. 1, a multi-apertured holder 10 mounted on base members 13 is shown provided with flat elongated shutters 11 positioned in a manner to occlude apertures 12 of said holder. A series of elongated cards collectively represented by the numeral 14 resides within the internal cavity 15 of holder 10. The game of the present invention comprises at least two, and preferably four of said multi-apertured holders. A number-selecting means in the form of a pair of dice 16 is shown in FIG. 1. However, other embodiments of number selecting means may be utilized such as for example a roulette-type spinner, a series of numbered cards, and other equivalent means which facilitate the random selection of a number between two and twelve. The dice of course have the particular advantage of providing the further capability of showing two separate numbers, particular pairs of which may be defined by the rules of playing the game to have special significance.

A series of playing pieces 18 is shown in the form of a series of flat, stackable chips or cards having indicia on one side thereof providing information to expedite the playing of the game. A series of scoring pieces 17 is shown having a format similar to that of the playing pieces but distinguishable therefrom by means of color difference or printed indicia. The scoring pieces are awarded to the players under proper circumstances during the playing of the game. Accumulation of an appropriate number of said scoring pieces constitutes victory in the game.

Figure 2:
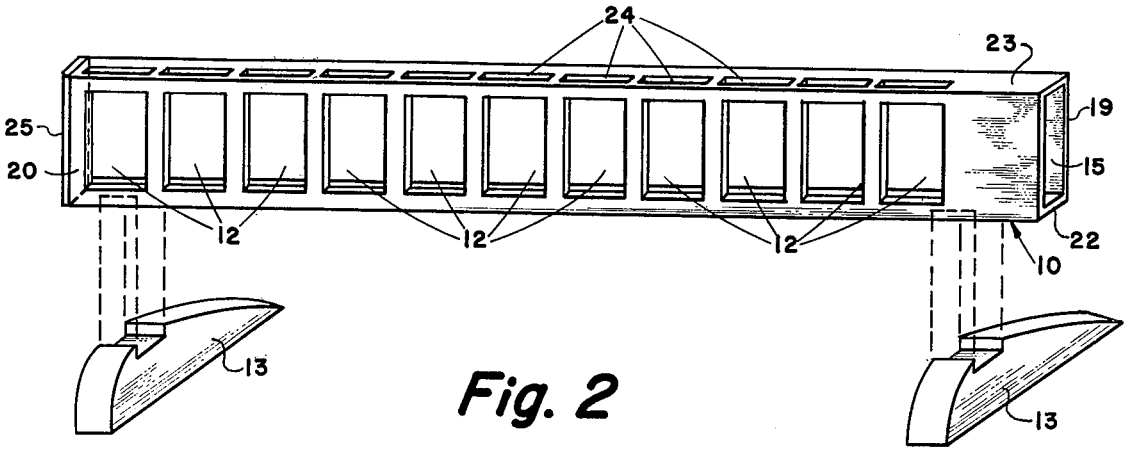
FIG. 2 is an isometric view of a multi-apertured holder supported by two removeable bases.

As shown more clearly in FIG. 2, the holder 10 is an elongated box-like structure having a rear panel 19, an opposed front panel 20 having eleven equally spaced identical rectangular apertures 12, a bottom member 22, a top member 23 disposed parallel to said bottom member and containing a series of elongated slot openings 24 positioned adjacent said apertures, and an end closure 25. The two identical pedestal bases 13 are adapted to support the holder a distance above the table or other playing surface, and preferably are readily detachable from said holder to facilitate compactness of the game components for purposes of storage, packaging and/or shipping.

Figure 3:
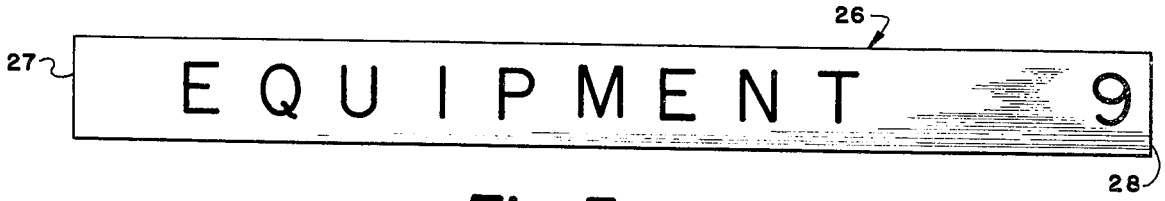
FIG. 3 is a plan view of an elongated card having a word printed thereon.

Elongated word cards 26 as illustrated in FIG. 3, have a rectangular contour dimensioned to fit snugly within holder 10 in a manner such that when inserted until contact is made with end closure 25, a portion of said elongated cards will protrude from said holder, as shown in FIG. 1. The front face of card 26 contains a printed word or other language indicia such as sign language symbols or hand gestures as used for teaching the deaf. Said indicia is arranged such that, when the left end 27 of said card is in abutment with end closure 25 of holder 10, the indicia will be centered within apertures 12 of said holder. Adjacent the right end 28 of each card there is imprinted on the front face a numeral indicating the number of letters or other indicia appearing on the face of the card, said number being no greater than 11. On the rear face of said cards 26 adjacent the right end thereof, the printed indicia of the front face is duplicated but in much smaller size.

Figure 4:
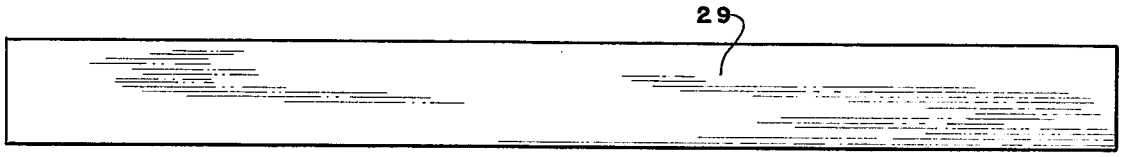
FIG. 4 is a plan view of a blank elongated card.

Elongated blank cards 29 as shown in FIG. 4 are identical in dimensions to the indicia-containing elongated word cards 26. The purpose of said blank cards 29 is to conceal the indicia of cards 26 when contained within holder 10, as will hereinafter be more fully explained.

Figure 5:
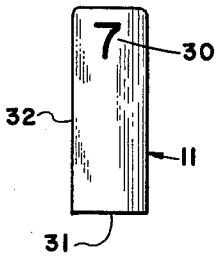
FIG. 5 is a plan view of an elongated shutter having a numeral on the upper part of both sides.

The flat shutter 11 shown in FIG. 5 is of elongated, substantially rectangular configuration, and intended to be utilized in a vertical orientation. A numerical indicia 30 appears adjacent the uppermost extremity on each face of said shutter, said indicia being a numeral from two to twelve. The width 31 of the shutter is such as to tightly fit into the slot openings 24 in the top member 23 of holder 10. The height 32 of the shutter is such as to permit the numerical indicia 30 to be visible above top member 23 when the shutter is inserted into slot opening 24 and in resting abutment with bottom member 22 of holder 10. A set of said shutters is provided for each holder, the different sets being differentiated by distinctive colors.

In a preferred embodiment, the game of the present invention is comprised of four card holders and bases therefor, four sets of eleven shutters, forty eight elongated word cards, four elongated blank cards, ten playing pieces, thirty eight scoring pieces, and a pair of dice.

In playing the game, each participant takes a holder 10. The elongated word cards 26 are placed front face down on the playing surface. Each player selects twelve of said cards. After being selected and arranged in a stack whereby the words are similarly oriented, the first word card is covered with a blank card 29 so that other players cannot see the word printed on said first word card. All twelve word cards 26 with said blank card in front of them are inserted into the open right end of holder 10 in a manner such that the words are upright and facing front panel 20, and the cards abut against end closure 25.

Each player selects a set of shutters and inserts them in random order into the slot openings 24 of the holder in a manner such that the shutters are in front of the elongated cards and occlude apertures 12 while the numerical indicia are displayed above the top of the holder, as shown in FIG. 1. With all the shutters in place, the blank covering card is removed from the holder, and the holder is positioned such that the apertures 12 face the other players.

If there are only two participants, each may utilize two card holders. Each player is to roll the dice to see which receives the lowest sum. The player with the lowest sum will start the game by rolling the dice again, and if the number happens to be seven, the player may choose one of the other player's card holders.

The player must guess what letter is behind the shutter having the number indicated by the dice. If the guess is correct, the player will take a playing piece. For convenience, the playing and scoring pieces are stored on the table or other surface upon which the game is played. The playing pieces permits the player to either roll the dice again or venture to guess the word on the selected word card. After exercising the advantage conveyed by possession of the playing piece, it is returned to its place of storage on the table.

If the number 6 appears, for example, such player may choose the same card holder, because that holder already has an exposed letter. If the letter cannot be guessed correctly by the first player, no further attempts can be made, and he loses his turn. So the next player to the left of the starting player takes his turn. When a player takes a turn, such player must roll the dice first. If the second player's dice happens to read double, (for example, 2 and 2), such player is to collect a playing piece. Before the playing piece is used, the player also has the opportunity to guess or identify a word letter. If the letter behind the No. 4 shutter, for example, of the chosen holder is answered correctly, it means that the player has two playing pieces (two attempts). After identifying a letter correctly, the second player can attempt to identify the word in the same holder, but if the player is not sure of the identification of such word, an attempt to roll the dice again and to guess a letter again may be made. For the attempt, one of the player's two playing pieces must be returned. If the sum of the number indicated on the dice happens to be four again, the second player loses the chance of using the same holder, because its No. 4 shutter is already opened, and said player may be forced to look for another holder with No. 4 shutter in a closed position. If the letter cannot be identified, the player still has one more playing piece to continue the play by rolling the dice again. If said player's letter guess is wrong again, he loses his turn.

A player can lose a turn if the number given by the dice doesnt't match one of any other card holders' closed shutters. So the third player takes a turn by tossing the dice and attempting to identify a letter. An answer to the numbered shutter which happens to be in the first window opening from the left can be wrong, because first letters of some words may not be shown in 1st, 2nd or 3rd window opening, depending upon the number of word letters. The third player must discontinue the play, because of the wrong answer, and loses his turn. Now the fourth player who takes a turn rolls the dice and chooses a card holder. In the event such player feels that he knows the identification of the word in the holder, identifying a letter must be first done. If the letter guess is right, the player then can attempt to identify the word. For the correct word answer, the such player takes a playing piece plus a scoring piece. Before the game resumes, the player of the card holder in which the word has been correctly identified must put all mixed numbered shutters in the slots again. With all the apertures in a closed position, the player then removes the identified word card and inserts it into the holder between the back of the 12th word card and rear panel 19. In so doing, the 2nd word card moves toward front panel 20 where it takes the place of the 1st word card. The player of the card holder again needs to know the identification of the word imprinted on the front word card by pulling out the tip of said card slowly until the word printed vertically on the tip's back is seen. The word card must be returned back firmly against end closure 25. Care must be taken not to expose the word card if some of the apertures are open.

Then the fourth player resumes the game by tossing the dice after returning the playing piece. The game continues until the first player, for example, collects ten scoring pieces, thereby winning the game.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A game involving the spelling of words and played competitively by two to four participants, comprising:

(a) a series of elongated word cards, each having a word printed on the front face thereof, (b) multi-apertured holders adapted to insertively accommodate a number of said word cards, (c) elongated blank cards adapted to cover said word cards, (d) a multitude of flat elongated shutters adapted to be vertically positioned to separately occlude individual apertures of said holders, said shutters having numerical indicia adjacent the uppermost ends thereof, (e) a first series of playing pieces serving to expedite the playing of the game, (f) a second series of playing pieces which facilitate scorekeeping, and (g) number-selecting means, the spacing of the letters comprising the word on each word card being such that each letter is centered behind an aperture of said multi-apertured holder when said word card is inserted into said holder.

2. The game of claim 1 comprising forty eight of said word cards, four of said holders and bases therefor, four of said blank strips, four sets of eleven shutters, ten playing pieces of said first series, and thirty eight playing pieces of said second series.

3. The game of claim 1 wherein said holder has a rectangular box-like construction, the top of which contains elongated slots which permit insertion of said shutters.

4. The game of claim 1 wherein each of said elongated word cards has a numeral appearing adjacent the right hand end thereof on the front face containing the printed word, said numeral corresponding to the number of letters of said printed word and being no greater than eleven.

5. The game of claim 4 wherein the rear face of each word card contains imprinted thereon opposite the numeral on said front face the same word that appears on said front face but in smaller size.

6. The game of claim 3 wherein said shutters have a height such that, when inserted into the slots of said holder, the numerical indicia adjacent the uppermost ends of said shutters are positioned above the top of said holder.

* * * * *